US005937536A

United States Patent [19]

Kieselbach et al.

[11] Patent Number: 5,937,536

[45] Date of Patent: Aug. 17, 1999

[54] RAPID DRYING OVEN FOR PROVIDING RAPID DRYING OF MULTIPLE SAMPLES

[75] Inventors: Peter Kieselbach, Upper Black Eddy, Pa.; Ilya Feygin, Mountainside, N.J.; Joseph J. Brzezinski, Bangor, Pa.; Gregory L. Kirk, Skillman, N.J.; Thuc Nguyen, Bensalem, Pa.; Joseph A. Mollica, Princeton, N.J.

[73] Assignee: Pharmacopeia, Inc., Cranbury, N.J.

[21] Appl. No.: 08/944,860

[22] Filed: Oct. 6, 1997

[51] Int. Cl.[6] ..... F26B 13/30

[52] U.S. Cl. ..... 34/92; 34/202; 34/215; 34/222

[58] Field of Search ..... 34/92, 202, 210, 34/215, 222, 407, 408, 409, 410

[56] References Cited

U.S. PATENT DOCUMENTS

| | | | |
|---|---|---|---|
| 1,283,495 | 11/1918 | Gilliam . | |
| 1,461,393 | 7/1923 | Jenkinson . | |
| 1,766,742 | 6/1930 | Campbell . | |
| 3,136,240 | 6/1964 | Rabe . | |
| 3,742,614 | 7/1973 | Bettermann et al. | 34/92 X |
| 4,346,057 | 8/1982 | Bowser | 422/101 |
| 4,597,188 | 7/1986 | Trappler | 94/92 X |
| 4,736,529 | 4/1988 | Kramer | 34/224 |
| 5,038,494 | 8/1991 | Lundquist et al. | 34/92 X |
| 5,040,974 | 8/1991 | Lanham et al. | 432/121 |
| 5,105,557 | 4/1992 | Vadasz et al. | 34/60 X |
| 5,250,323 | 10/1993 | Miyazaki | 427/255.1 |
| 5,514,336 | 5/1996 | Fox | 422/64 |
| 5,582,801 | 12/1996 | DeWitt et al. | 422/131 |
| 5,715,612 | 2/1998 | Schwenkler | 34/470 |

OTHER PUBLICATIONS

Desai et al. "Recent Advances in the Generation of Chemical Diversity Libraries", Drug Development Research, vol. 33, pp. 174–188, 1994.

Pavia et al. "The Generation of Molecular Diversity", Bioorganic & Medicinal Chemistry Letters, vol. 3, No. 3, pp. 387–396, 1993.

Gallop et al. "Applications of Combinatorial Technologies to Drug Discovery. 1. Background and Peptide Combinatorial Libraries", Journal of Medicinal Chemistry, vol. 37, No. 9, pp. 1234–1251, Apr. 29, 1994.

Gordon et al. "Applications of Combinatorial Technologies to Drug Discovery. 2. Combinatorial Organic Synthesis, Library Screening Strategies, and Future Directions", Journal of Medicinal Chemistry, vol. 37, No. 10, pp. 1385–1401, 1994.

*Primary Examiner*—Henry Bennett
*Assistant Examiner*—Steve Gravini
*Attorney, Agent, or Firm*—Law Offices of Peter H. Priest

[57] ABSTRACT

A dryer for use with chemical compounds employs controlled vacuum, elevated temperature and dry, inert gas to dry the chemical compounds. The dryer includes a vacuum chamber into which trays containing the compounds are placed. The chamber includes heating elements which elevate the temperature of chemical samples placed within the chamber. Supplying and evacuating manifolds, each with a plurality of orifices for supplying and evacuating dry inert gas, provide a substantially laminar flow of dry inert gas just above the trays of chemical compounds which are to be dried. The laminar gas flow removes the unwanted vapor which tends to form above the tray of chemical compound, thus accelerating the drying process.

17 Claims, 5 Drawing Sheets

RAPID DRYING OVEN FOR PROVIDING RAPID DRYING OF MULTIPLE SAMPLES

BACKGROUND

1. Field of the Invention

The present invention is related generally to drying systems and, more particularly, to drying systems which are capable of rapidly drying chemical reaction products held in cavities or wells.

2. Description of the Related Art

Combinatorial chemical synthesis permits the production of very large numbers of small molecule chemical compounds which may, for example, be tested for biological activity. One combinatorial synthesis method employs polymeric resin beads as solid phase substrates upon which small molecule compounds are formed. In this method, sometimes referred to as the "mix and split" method, a sample of beads is divided among several reaction vessels and a different reaction is performed in each vessel. The beads from all the vessels are then pooled and redivided into a second set of vessels, each of which now contains approximately equal amounts of beads carrying the products of the first set of reactions. When a second reaction is performed, each of the products of the first set of reactions acts as a substrate for a new set of reactions which produce all the possible combinations of reactants. The mix and split combinatorial chemical synthesis method is discussed in greater detail in, M. A. Gallop, R. W. Barrett, W. J. Dower, S. P. A. Fodor, and E. M. Gordon, Applications of Combinatorial Technologies to Drug Discovery, 1. Background and Peptide Combinatorial Libraries, Journal of Medical Chemistry 1994, Vol. 37, pp. 1233–1251; E. M Gordon, R. W. Barrett, W. I. Dower, S. P. A. Fodor, M. A. Gallup, Applications of Combinatorial Technologies to Drug Discovery, 2. Combinatorial Organic Synthesis, Library Screening Strategies and Future Directions, Journal of Medical Chemistry 1994, Vol. 37, pp. 1385–1401; M. R. Pavia, T. K. Sawyer, W. H. Moos, The Generation of Molecular Diversity, Bioorg. Med. Chem. Lett. 1993, Vol. 3, pp. 387–396 and M. C. Desai, R. N. Zuckerman, W. H. Moos, Recent Advances in the Generation of Chemical Diversity Libraries, Drug Dev. Res. 1994, Vol. 33 pp. 174–188 which are hereby incorporated by reference. See also, U.S. Pat. No. 5,565,324 which is also hereby incorporated by reference.

By providing an extremely large library of chemical compounds for testing, combinatorial chemical synthesis provides support for the development of compounds which may be used to develop new drugs for treating a wide range of diseases. Rather than painstakingly synthesizing chemicals one at a time and individually testing them for biological activity with, for example, an enzyme involved in heart disease, or a cell receptor involved in fighting cancer, many chemicals can be developed and tested in parallel, greatly accelerating the drug development process and, hopefully, leading to major advances in the treatment and prevention of disease.

Tests, such as those for biological activity, are often performed upon the compounds at a different location from that where they are formed. For convenience of handling and to ease the testing of large numbers of compounds, samples of a variety of compounds are often placed within the wells of a plate which contains an array of wells. Alternatively, each well may contain the same compound, so that a number of tests may be conducted on the same compound simultaneously. Plates such as these are conventional and a number of standard arrays are available, including a ninety-six well plate. Wells within the plates are generally available in either deep or shallow configurations. To reduce spills and the likelihood of cross contamination and to prevent degradation of the samples due, for example, to oxidation, reaction products placed within the wells are dried, by evaporating the solvents and other volatiles in which the chemical products are immersed preferably in an inert atmosphere.

Although the benefits of drying the compounds are several, the time and expense required to dry them using traditional drying systems and techniques can be burdensome. For example, freeze drying the compounds may take several says and many times requires unwanted fillers, such as sugars. Drying by placing the compounds under a controlled vacuum may require between five and ten hours for the drying, assuming shallow well plates. A typical convection based drying oven for drying such compounds may also require on the order of ten hours for a shallow well plate and considerably more for a deep well plate.

One reason for the long drying times is that vapor forms immediately above the samples, and accumulates in the semi-closed volumes of the wells. This vapor slows the drying process. To eliminate the accumulated vapor and thus accelerate drying, some conventional dryers insert jets of inert gas directly into each of the wells. While the dry inert gas does tend to displace the vapor and thus accelerate drying, the introduction of large volumes of inert gas into the vacuum chamber imposes the requirement of a much larger vacuum pump for the system. Additionally, the use of large volumes of inert gas adds considerably to the expense of operating a drying system.

Another technique, the GeneVac™ sold by GeneVac Limited of Ipswich, England, employs a centrifuge which holds shallow or deep well plates and spins those plates within an evacuated and heated chamber. While this unit operates relatively quickly, it has the drawbacks of low mechanical reliability, low capacity, difficult loading and unloading, and high expense.

High vacuum ovens may provide the benefit of rapid drying, however, the solvents have been known to be susceptible to spontaneous boiling, also known as "bumping". Bumping can be process critical as it may cause contamination and loss of compound. This is particularly true for low boiling point solvents.

The compounds being evaporated may also include any of a number of corrosive chemicals. A drying system which provides rapid, inexpensive drying of chemical compounds without requiring the use of large volumes of inert gases and which can withstand exposure to corrosive chemicals would therefore be highly desirable. Additionally, it is further desirable to control temperature and pressure in a controlled manner which prevents degradation and bumping without unnecessary moving parts.

SUMMARY OF THE INVENTION

The present invention is directed to relatively inexpensive drying systems which may be suitably employed., for example, to rapidly dry the reaction products of combinatorial chemical synthesis without oxidation.

The invention addresses these and other problems by providing a chamber within which the temperature and pressure may be precisely controlled to facilitate rapid drying of samples placed within the chamber. Additionally, in a currently preferred embodiment, a substantially laminar flow of dry inert gas is forced across the top of sample trays or plates placed within the chamber. The inert gas flow above the plates disrupts the accumulated vapor which tends to form within individual wells containing the chemical compounds and carries away the vapor, thus accelerating the drying process without forcing large volumes of inert gas into the individual wells.

In one embodiment, the invention may suitably comprise a vacuum chamber with a temperature controlled heat source and an inert gas delivery system. In operation the inert gas delivery system establishes a substantially laminar flow of dry inert gas over the tops of wells which contain the chemical compounds to be dried. The gas flow above the plates creates gas flow patterns which effectively churn the accumulated vapor of the wells. Shelves within the chamber provide support for the sample trays or plates which incorporate the wells containing the chemical compounds. The shelves are preferably located just below manifolds which are formed to supply a substantially laminar flow of inert gas across the sample trays and to evacuate the inert gas from the vacuum chamber. Additionally, in a currently preferred embodiment, the shelves conduct heat to the trays of compounds which they support.

In a preferred embodiment, two gas-supplying manifolds are included for each shelf, with one manifold located higher than the other in order to accommodate taller plates with deeper wells. Although, for simplicity of manufacturing, the currently preferred manifolds contain linear arrays of circular orifices, other orifice shapes and arrangements which effectively churn out accumulated vapor utilizing inert gas flows are contemplated by the invention. The presently preferred laminar gas flow removes the unwanted vapor which tends to form above the tray of chemical compounds, thus accelerating the drying process. These and other features, aspects and advantages of the invention will be apparent to those skilled in the art from the following detailed description, taken together with the accompanying drawings.

DETAILED DESCRIPTION

A new drying system in accordance with the present invention will preferably provide a combination of moderate heat and reduced pressure to substantially accelerate the evaporation of liquids, typically solvents, from the wells of multi-well plates which also contain a chemical compound of interest that is to be preserved. A laminar flow of dry inert gas across the top of the plates rapidly removes vapors which otherwise tend to accumulate within the well. Shallow well plates may be dried in only four hours using the new drying system, compared to eighteen hours required for conventional convection drying. Deep well plates, which conventionally require two to three days of convection drying plus a vacuum oven finishing step, require only six hours in the new drying system. As opposed to convection drying utilizing air, the new drying system virtually eliminates oxidation of the chemical products of interest, which are left behind in the wells after evaporation.

Figure 1:
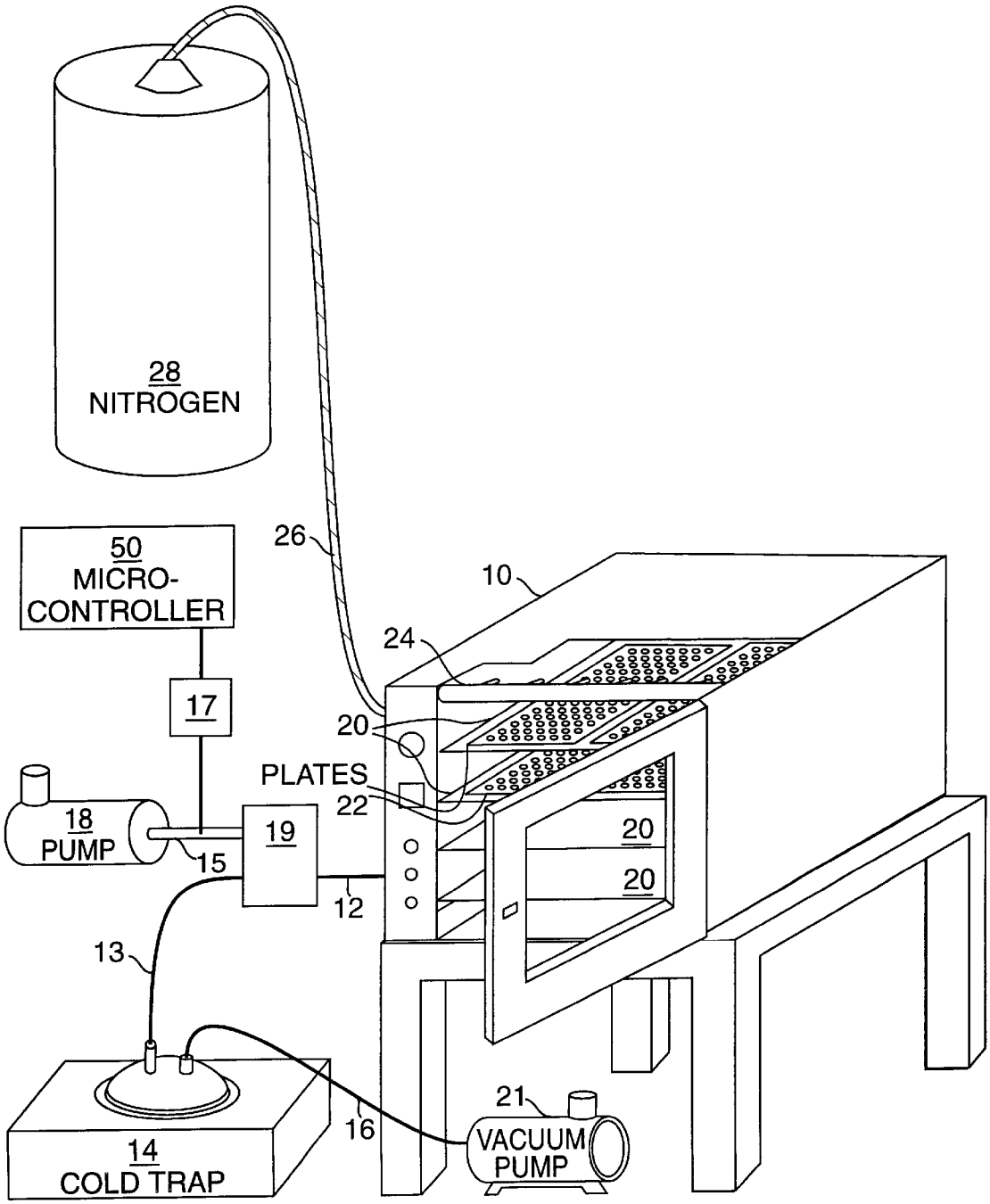
FIG. 1 is a perspective view of a vacuum drying system in accordance with the present invention.

A preferred embodiment of the new drying system is illustrated in the partial sectional view of FIG. 1. As shown in FIG. 1, a vacuum oven chamber 10 is connected through a vacuum line 12 to a valve system 19 which may be suitably employed to connect either a high vacuum pump 21 to the chamber 10 through a vacuum line 16, a cold trap 14, and a vacuum line 13, or a high flow capacity pump 18 through a vacuum line 15. A dryness sensor 17 may be included in vacuum line 15, or, alternatively in line 13. This sensor 17 may then be connected to a suitably programmed microcontroller or microprocessor 50 which in turn controls the overall operation of the system. The chamber 10 is preferably coated with a chemically tolerant plastic, such as Teflon™, available from Dupont Corporation and all exposed hardware within the chamber 10 is preferably composed of titanium. Shelves 20 within the chamber provide support for vessels 22, such as micro well or microtiter plates, each of which contains a plurality of wells or cavities for holding compounds which are to be dried. An example of such a plate is a 96-well microtiter plate.

The shelves 20 are preferably made of aluminum and are also preferably coated with a chemically tolerant plastic, such as Teflon™. All downstream exposed parts, including plumbing, valves and the diaphragm pump 18 are preferably composed of or coated with such a chemically tolerant plastic or a combination of such plastic and ceramic. The chamber 10 is preferably heated by external heating elements and the shelves 20 are preferably attached to the chamber 10 so that they are efficiently heated by conduction from the chamber walls. This approach to heating provides reliable heating and, at the same time, minimizes the possibility of unwanted condensation on the interior of the chamber walls. An inert gas, preferably nitrogen, is supplied to the chamber through a manifold 24 which is connected through tubing 26 to a nitrogen source 28. Nitrogen and other gases and vapors are evacuated from the chamber through an evacuation manifold or manifolds 34, illustrated in FIG. 2. As an alternative or in addition to the heating elements, the temperature of the incoming nitrogen or other inert gas can be controlled to compensate for the evaporation cooling.

Figure 2:
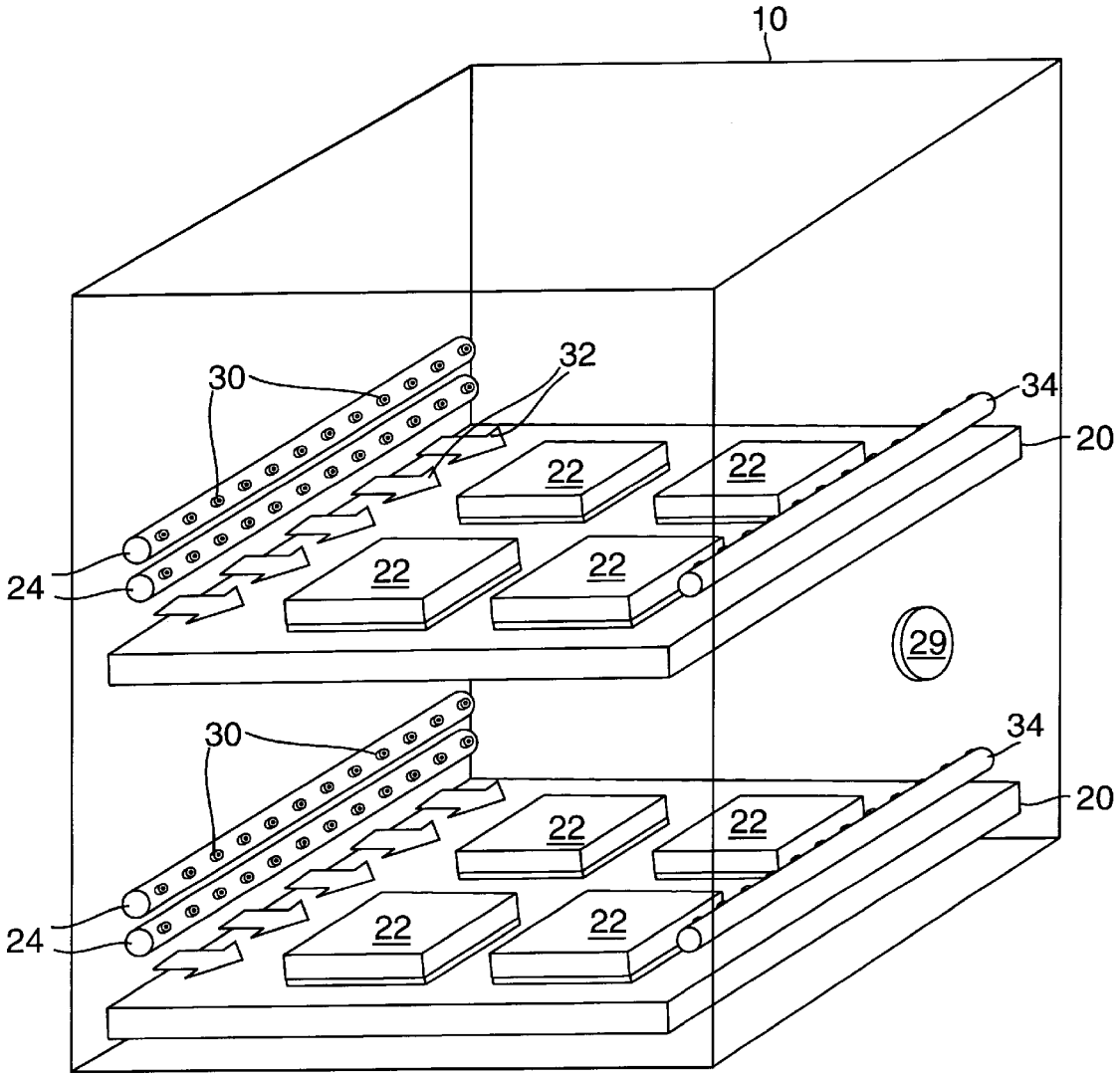
FIG. 2 is a perspective view of the interior of a vacuum chamber which may suitably be used in the new drying system of FIG. 1.

The interior of the chamber 10 is illustrated in greater detail in the perspective view of FIG. 2. A vacuum pressure sensor 29 is preferably mounted to a wall of the chamber 10. This sensor is connected to the controller 50 which controls the pumps 18 and 21 and the valve system 19 to control the pressure in the chamber 10 during drying so as to prevent bumping as described in greater detail below.

Multi-well plates 22 are supported within the chamber 10 upon shelves 20. In the currently preferred embodiment, supplying manifolds 24 provide nitrogen through 0.38 mm diameter circular orifices 30 which are arranged in a linear array on 12.7 mm centers. Two supplying manifolds are provided per shelf 20, with thirty-six orifices per manifold. The upper manifolds are used for deep well plates and the lower are used in conjunction with shallow well plates. A substantially laminar flow of nitrogen, depicted by arrows 32, is established by evacuating the nitrogen through evacuating manifolds 34 located opposite the supplying manifolds. The exhaust manifolds also include a linear array of orifices. The inside diameter of the manifolds, the number and diameter of orifices within the manifold and the plumbing connecting the manifold to the vacuum pump 18 are selected to provide adequate laminar flow of nitrogen under normal operating conditions. In the presently preferred embodiment, there are thirty four orifices measuring 0.813 mm in diameter. The laminar flow established in this manner provides even drying rates for all the wells within the plates 22. The lower supplying manifold is preferably located approximately 2.5 cm above the shelves 20, the evacuating manifold is 38 mm above the shelf 20 and the higher supplying manifolds are located approximately 5.1 cm above the shelves 20.

Figure 3A:
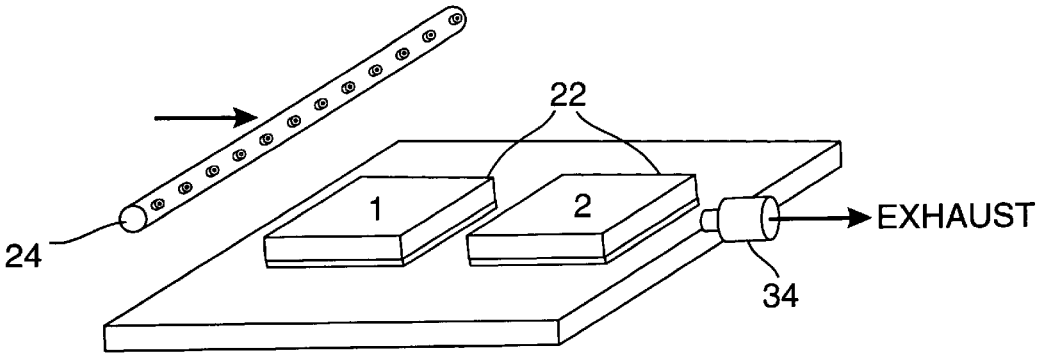
FIGS. 3A and 3B are perspective views of the interior of a vacuum chamber illustrating the use of a stationary supplying manifold and single exhaust port, a rotating supplying manifold and a single exhaust port, and four supplying jets with a single exhaust port, respectively.
Figure 3B:
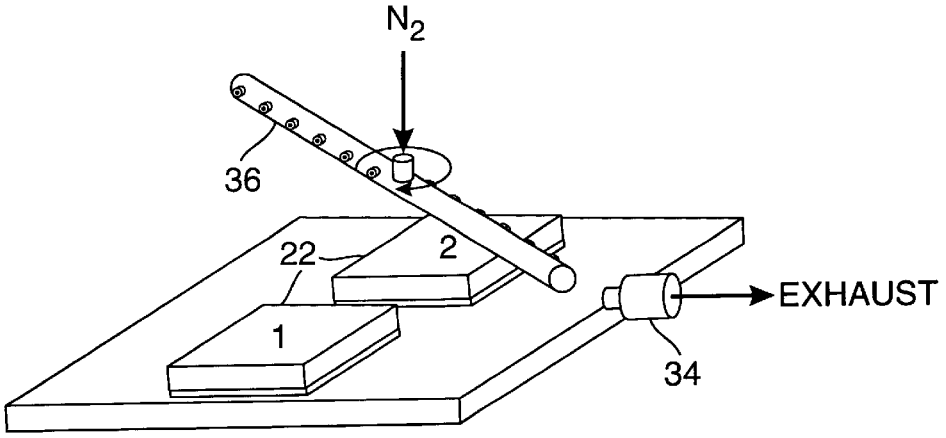
Figure 3C:
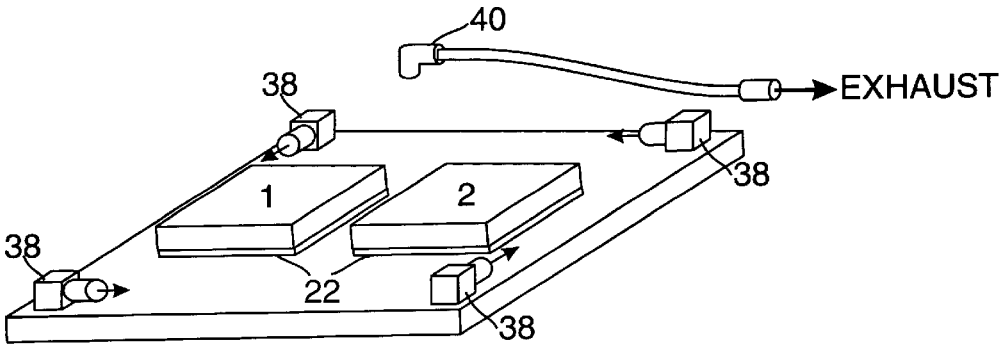

Alternative inert gas supply and evacuation configurations are illustrated in the block diagrams of FIGS. 3A, 3B and 3C. In FIG. 3A, the supplying manifold 24 and plates 22 are as previously described; however, evacuation of gases is carried out by a single evacuation port 34. In the block diagram of FIG. 3B, a single rotating manifold 36, located approximately 2.5 cm above the plates 22, supplies inert gas and a single evacuation port 34 evacuates gases. The manifold 36 may be rotated by the reactive force established by jets of inert gas supplied by the manifold 36. Rather than employing manifolds, the configuration of FIG. 3C uses a single supplying port 38 in each of the four corners of the chamber. The openings of the supplying ports are directed to establish a vortex of inert gas. At the center of the vortex a single evacuation port 40 is suspended approximately 2.5 cm above the plates 22. All the illustrated configurations establish flow patterns of inert gas over the plates 22, rather than constant direct flow into individual wells within the plates 22. The invention contemplates other inert gas supplying and evacuating configurations as well which operate to suitably and efficiently churn accumulated vapor out of the wells.

Figure 4:
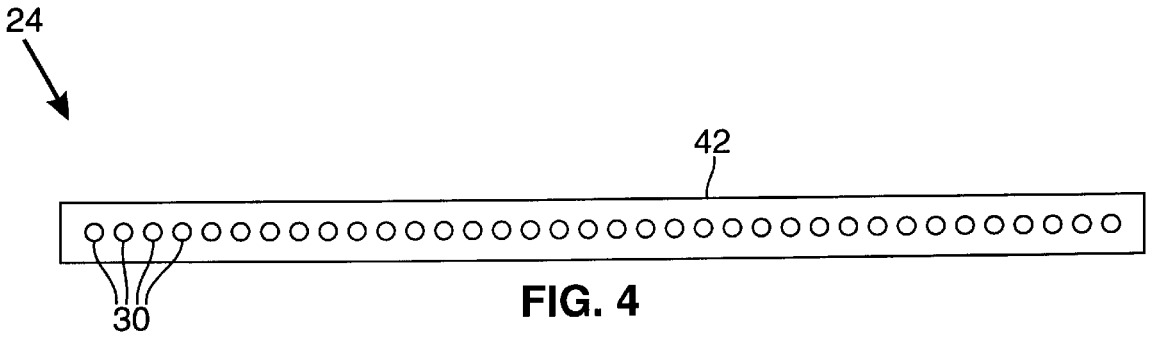
FIG. 4 is a plan view of a stationary supplying manifold.

FIG. 4 provides a more detailed view of a supplying manifold 24. The manifold 24 preferably comprises a tube 42 composed of stainless steel and coated with a chemically resistant plastic, such as Teflon™. Thirty six orifices 30, measuring 0.38 mm in diameter are evenly distributed in a linear array along the length of the tube 42. Precision machining techniques, such as laser ablation or electron deposition machining are preferably employed to insure that the orifices 30 are precisely formed to be straight and parallel to one another.

Figure 5:
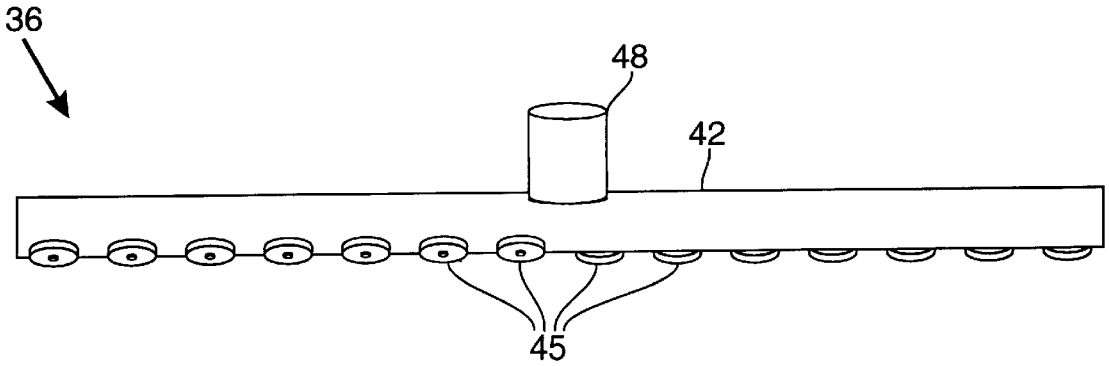
FIG. 5 is a plan view of a rotating supplying manifold.

The rotating supplying manifold 36 is depicted in greater detail in the elevation view of FIG. 5. The tube 42 is as previously described in relation to FIG. 4. The bar is suspended from a rotating fixture 48 through which inert gas may be forced. The jets 45 on either side of the fixture 48 are directed with their openings in opposite directions. All the jet's openings, or orifices, are directed slightly below horizontal to establish a flow of inert gas, which, in this case may be substantially turbulent, across plates 22 resting on shelves below. By rotating the fixture, nitrogen is intermittently supplied so that accumulated vapor is removed, reforms and is removed again as the jet rotates past a given well. This approach results in a saving of nitrogen while still working quite effectively.

Figure 6:
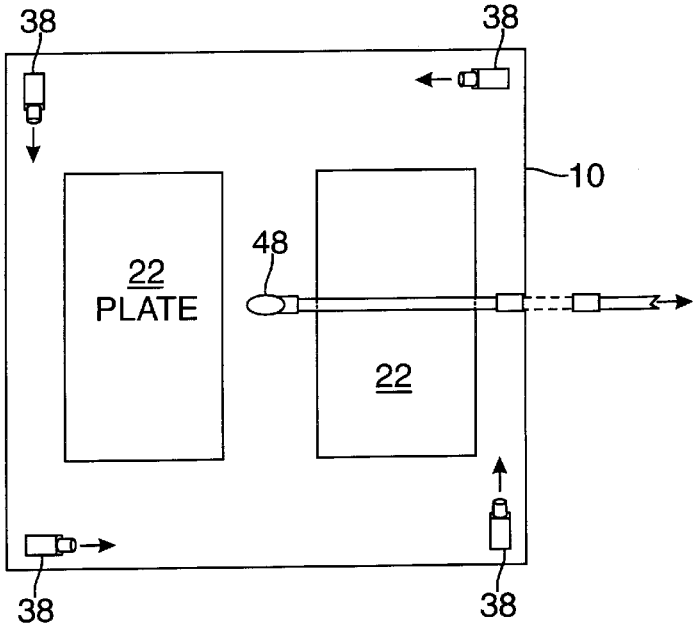
FIG. 6 is a top plan view of the interior of a vacuum chamber which employs four supplying jets and a single exhaust port, as in the perspective view of FIG. 3C.

The top plan view of FIG. 6 illustrates the four jet arrangement of FIG. 3C in greater detail. Jets 38 and plates 22 are as described above and are situated in each of the chamber's four corners. The direction of nitrogen flow from the jets 38 is indicated by arrows. The evacuation port 48 is located approximately at the center of the chamber 10 about 2.5 cm above the plates 22. This configuration establishes a flow of nitrogen which accelerates drying of the contents of the plates, with the drying taking place at substantially the same rate for all the wells.

Figure 7:
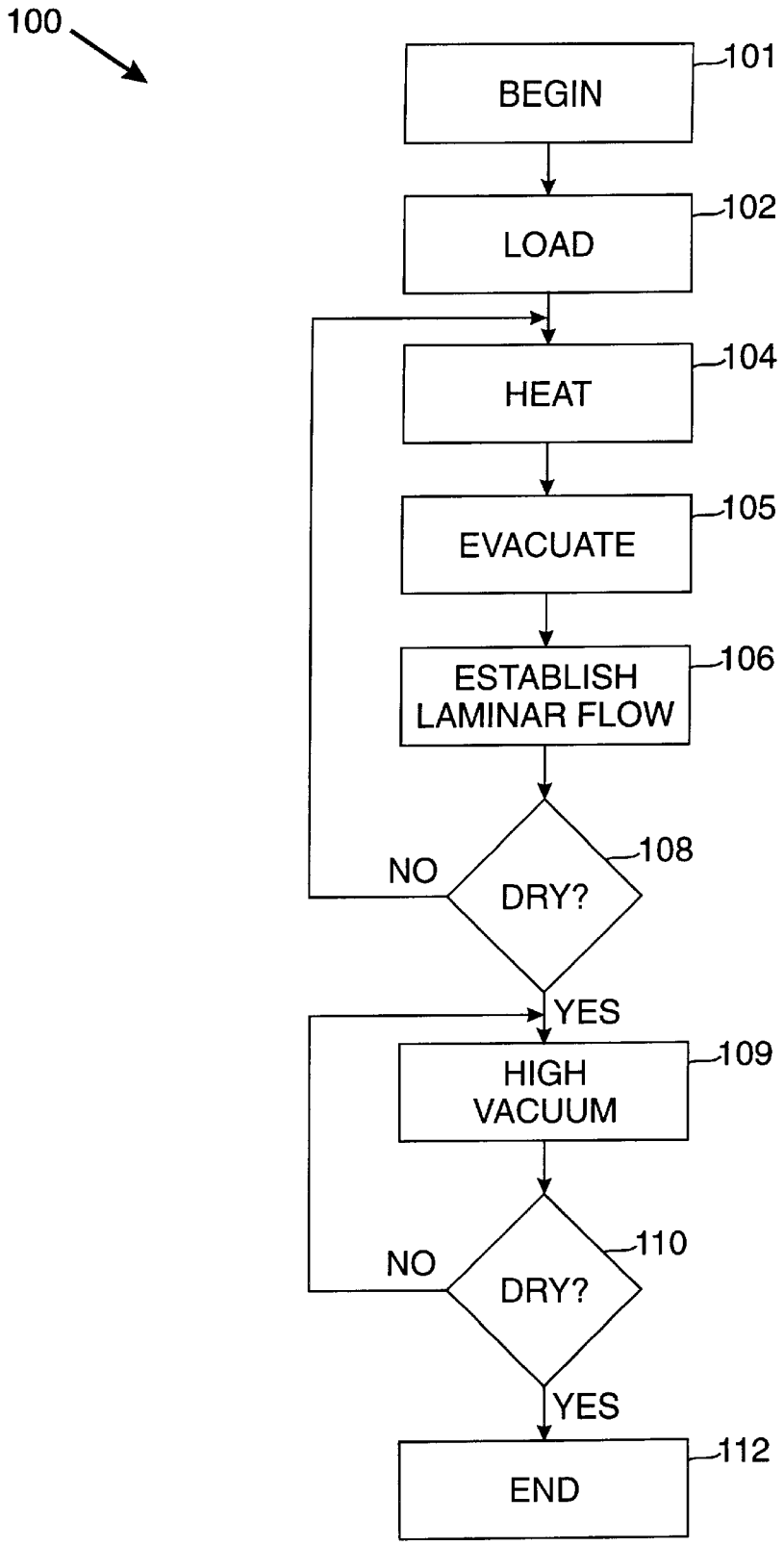
FIG. 7 is a flowchart illustrating various aspects of drying methods in accordance with the present invention.

The flow chart of FIG. 7 sets forth the basic steps in the preferred method of drying 100 according to the present invention. The process begins in step 101 then proceeds to step 102 where the chamber is loaded with materials which are to be dried, such as a microtiter plate or plates containing solvents and chemical compounds of interest within small wells in the plates. In step 104, the temperature of the chamber shelves 20 is elevated to accelerate evaporation, but only to a level that will not damage the plate materials or chemical products. The drying temperature is also preferably controlled to be below the boiling point of solvents within the wells. In step 105, the chamber is evacuated to a low vacuum, one which accelerates evaporation, but does not initiate boiling of the chemical products. Typical operating ranges are 25° to 50° C. and 400 to 200 Torr. In step 106, a laminar flow of nitrogen across the tops of the plates is established by injecting nitrogen from the supplying manifold at a rate of approximately 22 standard cubic feet per hour (scfh) when drying four plates having ninety six wells per plate. The chamber's temperature and pressure are maintained at this level until the majority of the solvent is evaporated and the remaining volume of solvent is too low to allow boiling or "bumping" to occur. In step 108, a timer is checked to determine whether a programmed time interval has expired. The time interval may be preset based upon measurements made with similar mixtures and quantities under laboratory conditions. When sufficiently dry, as indicated in the presently preferred embodiment by expiration of the time interval, in step 109, the nitrogen flow and low vacuum pump are turned off and a higher vacuum pump lowers the pressure within the chamber, typically to 5 Torr or less, to accelerate the evaporation of the remaining solvents. The process then proceeds to step 110, where measurements are made to determine whether the materials are as dry as desired. By way of example, the exhaust products may be tested with an appropriate sensor or sensors in the exhaust line, such as sensor 17, subject to microprocessor control. It will be recognized that in step 108 an actual dryness test may be employed as an alternative or in addition to the timer to control the beginning of step 109 processing. When the final level of dryness is achieved, the process proceeds to step 112, the end. The dried plates may then be removed for further processing as desired.

The forgoing description of specific embodiments of the invention has been presented for the purposes of illustration and description. It is not intended to be exhaustive or to limit the invention to the precise forms disclosed, and many modifications and variations are possible in light of the above teachings. For example, the number and size of apertures within the various manifolds, the temperatures, flow rates and pressures employed may differ from those disclosed depending upon factors such as the depth and the number of sample plates, the type and volume of solvent to be evaporated and the like. Additionally, the proximity of supplying and evacuating manifolds to the wells which are to be dried may be altered, for example, to suit the particular plates, wells and liquid products to be dried. The embodiments were chosen and described in order to best explain the principles of the invention and its practical application, to thereby enable others skilled in the art to best utilize the invention. It is intended that the scope of the invention be limited only by the claims appended hereto.

We claim:

1. A rapid drying system for accelerating the evaporation of a liquid from wells of a multi-well plate containing a chemical compound of interest that is to be dried, comprising:

a vacuum chamber which includes support for at least one plate with the chemical compound to be dried contained within at least one well formed in the plate;

a heating element connected to provide heat to accelerate the evaporation of said liquid and to dry said chemical compound; and an inert gas delivery system connected to supply a substantial flow of inert gas across the top of said at least one plate supported by said support.

2. The drying system of claim 1 wherein said flow is substantially laminar.

3. The drying system of claim 2, wherein said inert gas delivery system includes supplying and evacuating manifolds, with the supplying manifold arranged along one side of the chamber and the evacuating manifold arranged along the other side.

4. The drying system of claim 2, wherein said manifolds include a linear array of orifices formed along the side of the manifold which faces the interior of the chamber.

5. The drying system of claim 4, wherein said orifices are circular, straight and substantially parallel to one another.

6. The drying system of claim 4, wherein said support for a at least one plate comprises a shelf within said chamber.

7. The drying system of claim 6, wherein upper and lower supplying manifolds are arranged, one above the other, for each shelf, with the upper manifold located at a height above the shelf which will support a laminar flow of inert gas across a deep well plate and the lower manifold located at a height above the shelf which will support a laminar flow of inert gas across a shallow well plate.

8. The drying system of claim 7 further comprising a mechanism to switch between the upper and lower manifolds so that only one operates at a time.

9. The drying system of claim 7, wherein the vertical distance between said manifold and said support is adjustable.

10. The drying system of claim 9, wherein said vertical distance is adjustable by movement of said manifold.

11. The drying system of claim 10, wherein said vertical distance is adjustable by movement of said support for at least one plate.

12. The drying system of claim 1, further comprising a vacuum pump connected to said chamber through vacuum lines to evacuate said chamber.

13. The drying system of claim 12, further comprising a cold trap connected through vacuum lines with said pump to substantially reduce the amount of corrosive chemicals which are pumped through said pump.

14. A chemical compound drying system, comprising:

a vacuum chamber which includes support for at least one plate with the chemical compounds to be dried contained within wells formed in the plate;

a heating element connected to provide heat to said chemical compounds; and an inert gas delivery system comprising a rotatable supplying manifold suspended above said support and an evacuating manifold located below the level of said support so that said inert gas is intermittently delivered across the top of said at least one plate and into the wells within said at least one plate to conserve nitrogen while effectively removing accumulated vapor.

15. The drying system of claim 14, wherein said supplying manifold includes jets arranged at a shallow angle to the level of said support so that an influx of inert gas through said jets rotates the manifold and supplies a substantially turbulent flow of inert gas across the top of plates situated on said support.

16. The drying system of claim 15, wherein said evacuating manifold is located substantially at the center of said chamber.

17. A rapid drying system for accelerating the evaporation of a liquid or liquids from a plurality of wells of a microtiter plate containing a plurality of chemical compounds of interest that are to be dried, comprising:

a vacuum chamber which includes support for a plurality of microtiter plates with the chemical compounds to be dried contained within the wells formed in said plates;

a heating element connected to provide heat to accelerate the evaporation of said liquid or liquids and to dry said chemical compounds; and an inert gas delivery system connected to supply a substantial flow of inert gas across the top of said plates supported by said support.

* * * * *